US010179363B2

(12) United States Patent
Klos et al.

(10) Patent No.: US 10,179,363 B2
(45) Date of Patent: Jan. 15, 2019

(54) METHOD FOR PRODUCING A CAST STRIP OF MOLTEN METAL AND CAST STRIP

(71) Applicant: Outokumpu Nirosta GmbH, Krefeld (DE)

(72) Inventors: Wilfried Klos, Neuss (DE); Johann Wilhelm Schmitz, Baesweiler (DE); Gerhard Gräf, Illerkirchberg (DE); Markus Daamen, Aachen (DE)

(73) Assignee: Outokumpu Nirosta GmbH, Krefeld (DE)

( * ) Notice: Subject to any disclaimer, the term of this patent is extended or adjusted under 35 U.S.C. 154(b) by 120 days.

(21) Appl. No.: 14/431,570

(22) PCT Filed: Sep. 27, 2013

(86) PCT No.: PCT/EP2013/070275
§ 371 (c)(1),
(2) Date: Mar. 26, 2015

(87) PCT Pub. No.: WO2014/049150
PCT Pub. Date: Apr. 3, 2014

(65) Prior Publication Data

US 2015/0239039 A1 Aug. 27, 2015

(30) Foreign Application Priority Data

Sep. 28, 2012 (DE) ..... 10 2012 109 286

(51) Int. Cl.
*B22D 11/06* (2006.01)
*B22D 11/00* (2006.01)
*B22D 25/02* (2006.01)

(52) U.S. Cl.
CPC ..... *B22D 11/0622* (2013.01); *B22D 11/009* (2013.01); *B22D 11/0651* (2013.01); *B22D 11/0682* (2013.01); *B22D 25/02* (2013.01)

(58) Field of Classification Search
CPC ... B22D 11/009; B22D 11/06; B22D 11/0622; B22D 11/0651; B22D 11/0682
(Continued)

(56) References Cited

U.S. PATENT DOCUMENTS 3,483,915 A * 12/1969 Schneckenburger et al. ..... B22D 11/1206 164/417
2010/0300643 A1 12/2010 Albrecht-Frueh et al.

FOREIGN PATENT DOCUMENTS

DE 898135 11/1953
DE 19928836 A1 12/2000
(Continued)

OTHER PUBLICATIONS

Abstract of CN 2582783 Y, publication date Oct. 29, 2003.*
(Continued)

*Primary Examiner* — Kevin P Kerns
(74) *Attorney, Agent, or Firm* — The Webb Law Firm

(57) ABSTRACT

A method for producing a cast strip of molten metal, in which the molten metal passes through a casting gap defined by two oppositely rotating casting rollers and is shaped into the cast strip, as well as the cast strip that is produced. By providing the cast strip in the casting gap with a different thickness in a first length section extending in the longitudinal direction of the cast strip than in a second length section bordering thereon, a metal strip is produced that has length sections with different thicknesses.

13 Claims, 9 Drawing Sheets

(58) Field of Classification Search
USPC ..... 164/480, 428
See application file for complete search history.

(56) References Cited

FOREIGN PATENT DOCUMENTS

| | | | |
|---|---|---|---|
| DE | 19962754 | A1 | 2/2001 |
| DE | 10016818 | A1 | 10/2001 |
| DE | 10114269 | C1 | 5/2002 |
| DE | 102007003548 | B3 | 9/2008 |

OTHER PUBLICATIONS

Machine translation of DE 101 14 269 C1.*
Schneider, "Tailored Blanks—a Material for New Ways of Design", Thyssen Technische Berichte, pp. 97-106, Issue 1/92, Germany.

* cited by examiner

METHOD FOR PRODUCING A CAST STRIP OF MOLTEN METAL AND CAST STRIP

CROSS-REFERENCE TO RELATED APPLICATIONS

This application is the United States national phase of International Application No. PCT/EP2013/070275 filed Sep. 27, 2013, and claims priority to German Patent Application No. 10 2012 109 286.9 filed Sep. 28, 2012, the disclosures of which are hereby incorporated in their entirety by reference.

BACKGROUND OF THE INVENTION

Field of the Invention

The invention pertains to a method for producing a cast strip of molten metal, in which the molten metal passes through a casting gap defined by two oppositely rotating casting rollers and is shaped into a cast strip.

Description of Related Art

A method of this type is carried out on a two-roller casting device. When casting molten metals in such devices that are also referred to as "twin-roller casting machines," two casting rollers that are arranged axially parallel and internally cooled respectively rotate opposite to one another and define the longitudinal sides of a casting gap between one another. On its narrow sides, the casting gap is usually sealed by plates of a refractory material. The quantity of the liquid molten metal that is respectively poured into the casting gap is chosen such that a so-called "melt pool" is formed and maintained above the casting gap until the casting process is completed.

The molten metal that reaches the casting rollers from the melt pool respectively solidifies into a shell that is then transported into the casting gap by the respective casting roller. In the casting gap, the shells are pressed against one another such that the cast strip is formed of the respective shells and the molten metal enclosed in between. The cast strip that continuously exits the casting gap is removed, cooled and conveyed to further processing.

Strip casting makes it possible to directly produce metal strips of the molten metal. In this case, the casting rollers act similar to traveling chill plates. The casting rollers are cooled in order to realize a stationary casting operation. In order to obtain a uniform strip thickness referred to the strip width, the casting gap is slightly cambered over its width in order to compensate the width-dependent thermal expansion. This means that the casting rollers must have nearly the same radius referred to the axial direction in the exiting plane. Since the level of the molten metal between the casting rollers is usually identical in the direction of the strip width, the heat flow in the direction of the strip width also needs to be identical in order to obtain identical thicknesses of the material solidifying on the rollers. Different heat flows in the direction of the strip width lead to different thicknesses of the solidified shell at the exit of the rollers and therefore to a different deformation of the strip.

In order to ensure an adequate thermal conductivity, the casting rollers usually feature a roller body that consists of a copper alloy at least in the region of its circumferential surfaces. However, the outer surface of the casting rollers that comes in contact with the molten metal is subjected to significant mechanical and thermal stresses in practical applications. This applies, in particular, if the molten metal to be cast consists of a steel alloy. This is the reason why the outer surface of casting rollers used for casting steel are usually provided with a coating that has a greater hardness than the remaining material of the casting roller.

Different options for producing coatings and certain surface characteristics on casting rollers are described in DE 10 2007 003 548 B3. In this case, the objective of the respective coating or surface treatment consists of adjusting the surface characteristic in such a way that more uniform heat dissipation from the molten metal reaching the casting rollers is achieved. In this way, a uniformly advancing solid-liquid interface that ultimately ensures the formation of a likewise uniform cast structure can be realized in the molten metal contacting the casting rollers.

In practical applications, there is now a demand for flat products, i.e., strips and sheets, as well as blanks produced thereof, which have different thickness profiles over their width or length. Sheets of this type are required, for example, for the manufacture of safety-relevant structural components that are used in the construction of automobiles and should have optimized deformation characteristics during a crash despite their low weight. In this case, the thicker regions are situated at the location that is subjected to the highest stresses during a crash while thinner material thicknesses are provided at all other locations in order to reduce the weight due to the utilization of less material.

Different options are available for producing sheet metal blanks, of which such components can be manufactured. For example, the blanks can be assembled in the form of so-called "tailored blanks" of sheet metal blanks that have, for example, a different thickness, strength, deformability, etc. and are connected to one another, for example, by means of laser welding (SCHNEIDER u. PRANGE, "Tailored blanks, a material for new forms of construction," Thyssen Technische Berichte, Issue 1/92, pp. 97-106).

In addition, so-called "flexible rolling" (DE 199 62 754 A1) is also used in practical applications. In flexible rolling, a metal strip is guided through a rolling gap formed between two working rollers in a hot-rolling process. This rolling gap can be adjusted in such a way that different material sections with different strip thickness can be produced over the length of the metal strip. According to DE 100 16 818 A1, blanks with length sections of different thickness can furthermore produced by partially reducing the thickness of a sheet steel strip that is unwound from a sheet steel coil and has a constant thickness, namely by means of grinding in a grinding unit.

Based on the above-described prior art, it is the objective of the invention to disclose a method that makes it possible to produce a metal strip that has length sections of different thickness and forms an optimally suitable starting product for applications of the above-described type with reduced effort. The invention furthermore aims to disclose a correspondingly configured product.

SUMMARY OF THE INVENTION

According to the invention, a cast strip is produced of molten metal in that the molten metal conventionally passes through a casting gap that is formed between two oppositely rotating casting rollers and in which the cast strip is formed. According to the invention, the cast strip is in the casting gap provided with a different thickness in a length section extending in the longitudinal direction of the cast strip than in a second length section of the cast strip bordering thereon.

The invention is therefore based on the twin-roller casting process. In contrast to conventional strip casting, in which it is respectively attempted to achieve an optimally uniform thickness over the width of the cast strip, profiling of the strip is realized in accordance with the invention. To this end, the cast strip is in the casting gap impressed with at least one length section that has a different thickness than an adjacent length section.

Accordingly, the clear width of the casting gap between the casting rollers varies when the inventive method is carried out. In regions in which a thicker length section should be produced, the casting gap has a greater width, i.e., the circumferential surfaces of the casting rollers that define the width of the casting gap are spaced apart by a greater distance, while the distance between the circumferential surfaces of the casting rollers and therefore also the clear width of the casting gap is reduced in regions in which a thinner length section should be produced. In order to produce length sections of the cast strip that are shifted relative to one another referred to the center plane of the cast strip, i.e., realized asymmetrically in the direction of the thickness of the cast strip, it would be possible, for example, to assign to a circumferential section of one casting roller, which is spaced apart from the rotational axis of the respective casting roller by a greater distance, a circumferential section of the other casting roller, which is spaced apart from the rotational axis of this casting roller by a shorter distance, and vice versa.

The invention therefore makes it possible to produce a strip that is cast of molten metal and already has the required non-uniform thickness distribution from the time of its creation in one continuous primary forming process. Such a cast strip that has at least two length sections with different thicknesses and is produced in accordance with the invention therefore forms an optimal starting product, for example, for being further processed into components, in which sheet metal sections with different thicknesses are assigned to zones that are subjected to different loads, in order to achieve the required load capacity of the component on the one hand and a minimal weight on the other hand.

A product that attains the above-defined objective therefore consists of a cast strip that is produced by casting molten metal and, according to the invention, features in the cast state and prior to any further shaping at least one length section, in which it has a different thickness than in a closest adjacent length section.

The term length sections of the cast strip with "different thicknesses" refers to sections that extend in the longitudinal direction and the lateral direction of the cast strip and in which the cast strip has a different cross-sectional shape in the direction of the thickness of the cast strip than in an adjacent length section.

Referred to the cross section or longitudinal section of the cast strip, the strip thickness of a strip cast in accordance with the invention therefore changes significantly between two adjacent length sections. At the same time, the section, in which the thickness differs relative to the respectively section bordering thereon, respectively occupies a certain width. The change in thickness may in this case also take place in the lateral direction of the cast strip, i.e., a length section of smaller thickness that extends in the longitudinal direction of the cast strip borders on an adjacent length section of greater thickness that lies next to the first length section and also extends in the longitudinal direction of the cast strip, wherein both length sections respectively occupy a portion of the width of the cast strip. Alternatively or additionally, the length sections that border on one another and have a different thickness may also follow one another in the longitudinal direction of the cast strip. In this case, a length section of smaller thickness that extends over the width of the cast strip borders, for example, on a length section that likewise extends over the width of the cast strip, but merely has a greater thickness.

The variation of the cross-sectional shape of the cast strip may therefore be the result of one length section being thinner than the respectively adjacent thicker length section. However, it is also possible to vary the cross-sectional shape by arranging length sections that have the same thickness measured in the direction of the thickness of the cast strip offset relative to one another. In this variation of the thickness, one length section therefore protrudes relative to the adjacent length section on one side of the cast strip and vice versa.

It is likewise possible to realize the length sections in such a way that one side of the cast strip is smooth and the profiling is limited to the other side of the caststrip only, i.e., the length sections of greater thickness only protrude relative to the length sections of smaller thickness on this side. In a symmetric configuration, the respective length section of greater thickness protrudes relative to the adjacent length section of smaller thickness on both sides of the cast strip by the same dimension, wherein this is not the case in an asymmetric configuration. In an inventive cast strip, length sections with a symmetric thickness profile referred to the center plane of the cast strip may naturally be combined with asymmetrically configured length sections.

The sections with different thickness impressed into the cast strip in accordance with the invention respectively have a certain length measured in the transport direction of the cast strip exiting the casting gap. In this case, it is possible to produce profiles, in which the length sections with different thickness respectively extend transverse to the transport direction over the entire width of the cast strip. Alternatively or additionally, the width of the length sections of different thickness may also be limited to a certain fraction of the width of the cast strip. It would likewise be conceivable to produce more complex configurations of the lateral and longitudinal extent of the length sections with different thickness. It is furthermore possible to vary the lateral extent of the length sections with different thickness, as well as the thickness of the respective length sections in their longitudinal direction. In order to impress the differently thick length sections into the cast strip in accordance with the invention, at least one of the casting rollers therefore features in practical application a circumferential surface section that is spaced apart from the rotational axis of the respective casting roller by a different distance than a closest adjacent circumferential surface section of this casting roller. If length sections should be produced, the length of which measured in the transport direction of the cast strip respectively corresponds to only a fraction of the circumferential length of the casting rollers, the circumferential section, the distance of which from the rotational axis is varied relative to its respectively adjacent circumferential section, respectively occupies only a fraction of the casting roller circumference. However, if a cast strip should be produced, in which the length sections of different thickness extend over the entire strip length, the casting roller respectively features at least one circumferential section that extends over its circumference and occupies part of its width, wherein this circumferential section has a different diameter than a circumferential section of the casting roller that respectively borders thereon.

In practical applications, the production of a cast strip in accordance with the invention is associated with the special challenge that the strip shells solidifying on the casting rollers respectively need to have a thickness that corresponds to the resulting strip thickness of the respective length section of the cast strip.

Consequently, heat flows of different intensity need to be locally dissipated in order to ensure that a more or less thick shell of solidified molten metal respectively forms on the circumferential section of the casting roller assigned to the respective length section. In order to achieve this different solidification, the invention proposes several measures that already lead to the desired result individually, but can also be used in combination with one another in order to control the strip shell growth in a suitable fashion. To this end, the heat transfer between the molten metal and the region of the respective circumferential section of the respective casting roller is adapted to the changing gap width in such a way that a greater gap width is compensated by a superior heat transfer and a smaller gap width is compensated by a reduced heat transfer. In a circumferential section of the respective casting roller that is assigned to a length section of the cast strip with smaller thickness, less heat is therefore withdrawn from the molten metal than in the respective region of a circumferential section that is assigned to a length section of the cast strip with greater thickness.

For this purpose, it would be possible, for example, to adapt in the circumferential section of the casting roller, in which a length section of greater thickness should be produced in the cast strip, the time period, during which the molten metal comes in contact with the casting roller and solidifies in the respectively assigned circumferential section. This can be achieved by increasing the filling level of the melt pool above the casting gap in the circumferential region in question such that the casting roller is in the circumferential surface section in question wetted with molten metal over a greater circumferential length than in a region of reduced filling level, in which a length section of smaller thickness should be produced in the cast strip. Different contact times result at a given rotational speed of the rollers. Accordingly, a thicker shell of solidified molten metal can grow in the region, in which a higher filling level is provided, than in the other region, in which a lower filling level exists, due to the prolonged contact between the molten metal and the casting roller.

Another option for controlling the growth of the shells being formed of the solidifying molten metal on the casting rollers consists of varying the heat flow dissipated from the molten metal into the respective casting roller. In a circumferential surface section that is assigned to a length section of greater thickness to be produced on the cast strip, the cooling of the roller may for this purpose be intensified relative to the cooling in a circumferential surface section that is assigned to a length section of the cast strip with smaller thickness. The casting rollers are therefore cooled in their lateral direction in accordance with the desired geometry of the thickness profile of the cast strip. In this way, the temperature gradient between the molten metal and the rollers is changed in such a way that the shells of solidified molten metal grow faster on the more intensely cooled circumferential surface section of the respective casting roller that is assigned to the length section of greater thickness of the cast strip than on the circumferential section that is assigned to the length section of smaller thickness of the cast strip. Consequently, the thermal resistance and therefore the local heat flow can be purposefully influenced by varying the microtopography or the coating thickness. This is associated with a different growth rate of the solidified shell.

One option for purposefully adapting the heat transfer between the molten metal and the respective circumferential section of the casting roller that can be easily implemented and therefore is significant for practical applications consists of suitably modifying the surface structure of the casting roller in the respective circumferential surface section. For this purpose, it would be possible, for example, that the circumferential surface sections assigned to the length sections of different thickness have a different roughness. The different surface roughness can be adjusted, for example, by means of a suitable peening treatment such as, for example, shot-peening or by means of a suitable application of a coating as described, for example, in DE 10 2007 003 548 B3. The heat flow changes due to the type and the degree of the roughness (Ra, Rz). Layers with a thickness in the range of 100-200 μm that are, in particular, thermally sprayed onto the roller surfaces increase the thermal resistance of the surface and therefore locally reduce the heat flow density. The reasons for this are the low thermal conductivity of the sprayed layer and the higher heat transfer through the highly fissured microtopography.

According to the invention, the circumferential surface section on the casting roller assigned to the length section with greater thickness may therefore be provided with a suitable topography by means of shot-peening or another surface treatment. The heat transfer from the molten metal into the casting roller generally decreases as the roughness of the circumferential surface of the casting roller coming in contact with the molten metal increases. This means that the circumferential surface section assigned to a length section, in which the cast strip should have a reduced thickness, can accordingly be provided with a greater roughness such that less heat is dissipated into the respective casting roller in this region while the circumferential surface section assigned to a length section of the cast strip with smaller thickness can have a reduced roughness in order to achieve a diminished heat dissipation and therefore a diminished growth of the shell solidifying in this circumferential surface section.

Alternatively or additionally, the heat transfer between the respective circumferential surface section of the casting roller and the molten metal may also be influenced by applying a coating. Suitable coatings consist, for example, of Fe—Cu—Fe and are applied by means of thermal spraying. Due to the application of a metal layer that decreases or increases the thermal resistance of the respective circumferential surface section, locally different heat flows and therefore different solidification rates are adjusted during the contact of the molten metal with the respective circumferential section. In this case, a coating that allows a greater heat flow from the molten metal into the respective casting roller is also applied onto a circumferential surface section that is assigned to a length section of greater thickness of the cast strip while the coating in a circumferential surface section assigned to a length section of a smaller thickness of the cast strip is realized such that a diminished heat flow and therefore a diminished shell growth occur.

The thickness of the coatings applied in the above-described fashion typically lies in the range of 100-200 μm. In this case, the heat transfer can on the one hand be influenced with the choice of the respective coating material.

Alternatively or additionally, the coating may be realized thinner in the region of the circumferential surface section assigned to a length section of greater thickness of the cast strip than in the region of a circumferential surface section of the respective casting roller that is assigned to a length section of smaller thickness of the cast strip, namely in accordance with the inverse ratio of the different heat transfer coefficients caused by the different thicknesses.

An inventive cast strip is typically produced of molten steel. Its length sections of different thickness may be realized such that they lie adjacent to one another and extend in the longitudinal direction of the cast strip. In this case, the length sections of different thickness may respectively extend over part of the length of the cast strip or over the entire length of the cast strip, if applicable in a periodically repeating fashion. Length sections that respectively occupy only part of the length of the cast strip may extend over the entire width of the strip.

It is also possible to realize mixed configurations of length sections of different thickness that extend over the width of the strip and over the length of the cast strip.

BRIEF DESCRIPTION OF THE DRAWINGS

The invention is described in greater detail below with reference to the drawings that show an exemplary embodiment. In these schematic drawings that are not true-to-scale.

DESCRIPTION OF THE INVENTION

Figure 1:
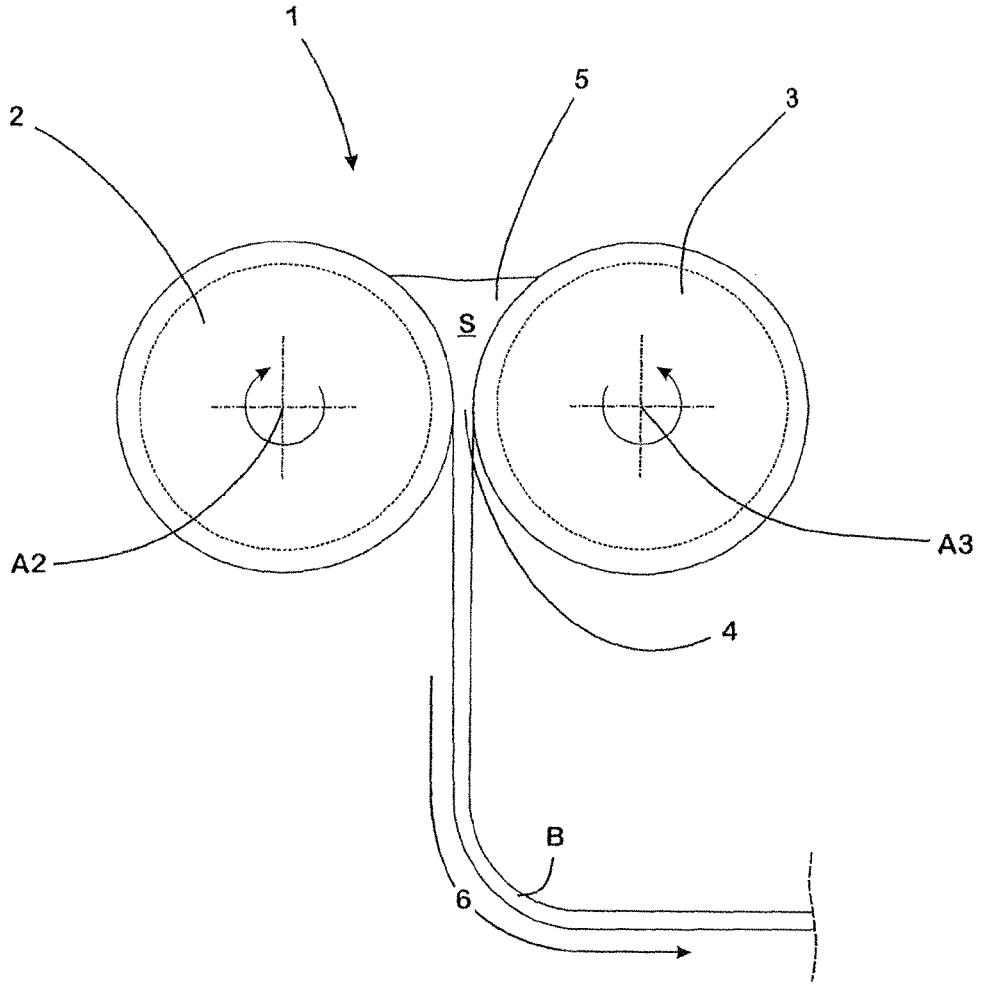
FIG. 1 shows a side view of a twin-roller casting machine for casting molten metal into a cast strip.

The twin-roller casting machine 1 illustrated in FIG. 1 serves for casting molten steel S into a cast steel strip B and has, in principle, a conventional design with two casting rollers 2, 3 that are arranged axially parallel to one another and rotate in opposite directions about their rotating axes A2, A3, wherein said casting rollers define the longitudinal sides of a casting gap 4 formed between the casting rollers, as well as of the melt pool 5 that is situated above the casting gap and into which the molten steel S to be cast is introduced. The two lateral narrow sides of the casting gap 4 and of the melt pool 5 are not defined by the casting rollers 2, 3 and respectively sealed by the plate-shaped lateral seals shown.

The cast steel strip B exiting the casting gap 4 is also conventionally transported away along a transport path 6. Starting at the casting gap 4, the transport path 6 features a first section that essentially extends vertically and then leads to a roller table that is essentially aligned horizontally in the form of an arc. Not-shown cooling devices are conventionally arranged along the transport path 6 and used for purposefully cooling the cast strip B in an accelerated fashion. The casting rollers 2, 3 respectively feature a roller body, the outer surface of which is made of a copper alloy.

In order to produce a cast strip B1 with three length sections L1-L3 of different thicknesses, the casting rollers 2, 3 feature three circumferential surface sections 10, 11, 12; 10', 11', 12' that respectively extend around their circumference and are spaced apart from the respective rotational axis A2, A3 of the casting rollers 2, 3 by a shorter distance G1, G2 than the circumferential sections 13, 14, 15, 16; 13', 14', 15', 16' that are arranged in between and laterally thereof and respectively spaced apart from the rotational axis A2, A3 of the respective casting roller 2, 3 by a greater distance G3.

Figure 2:
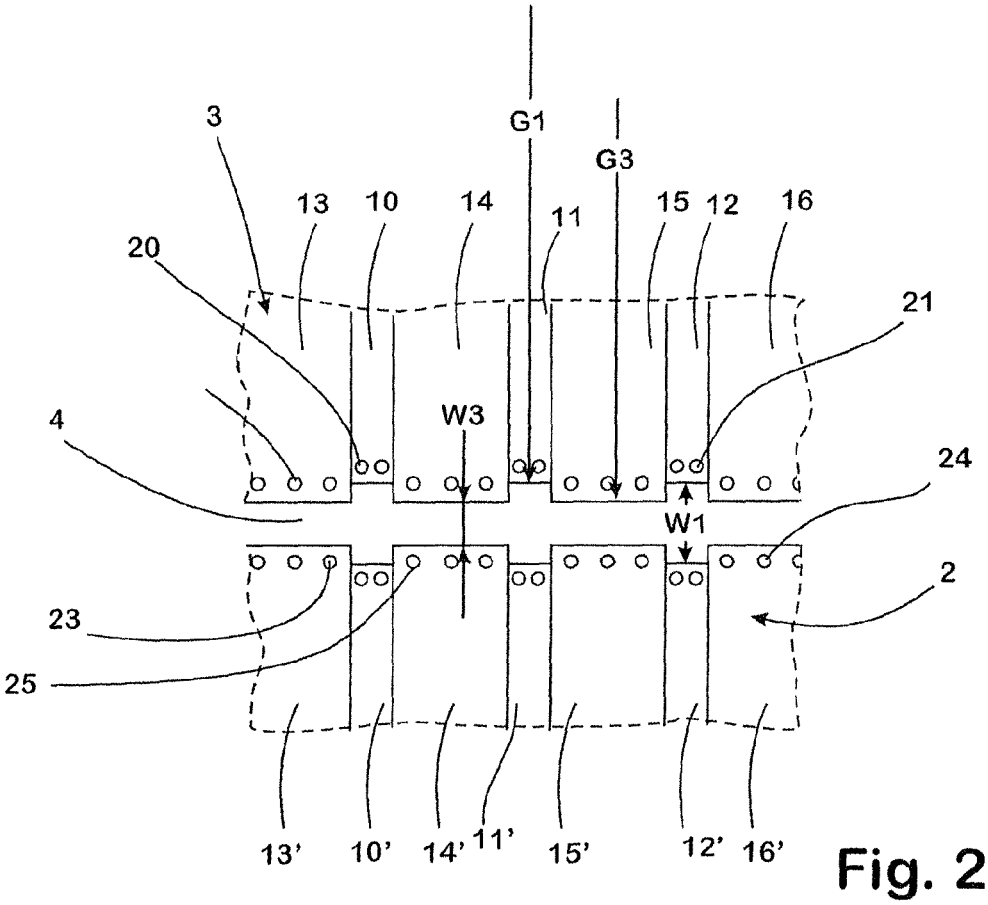
FIG. 2 shows a top view of a detail of the casting gap of the twin-roller casting machine according to a first embodiment.

In the embodiment illustrated in FIG. 2, the circumferential surface sections 10, 11, 12; 10', 11', 12' of the casting rollers 2, 3 are respectively spaced apart from the assigned rotational axis A2, A3 by the same shorter distance G1.

Figure 3:
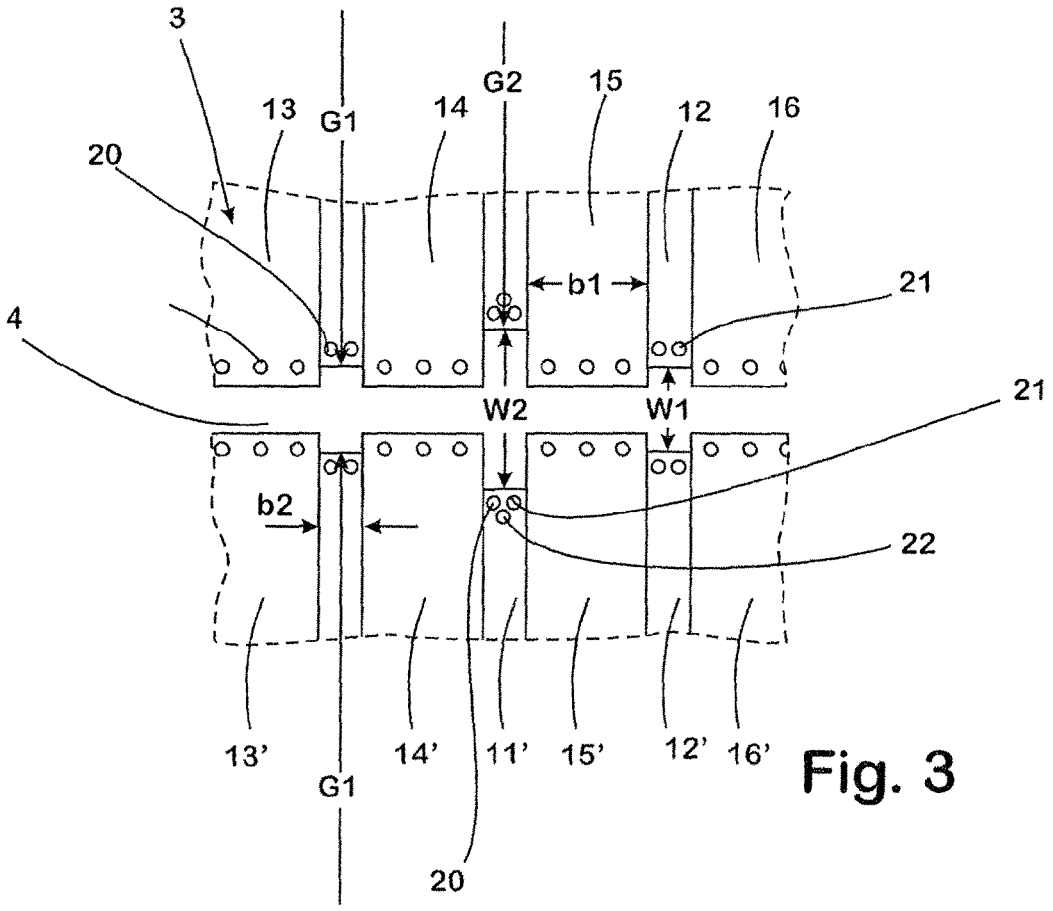
FIG. 3 shows a top view of a detail of the casting gap of the twin-roller casting machine according to a second embodiment.

In the embodiment illustrated in FIG. 3, in contrast, the distance G1 of the respectively outer circumferential surface sections 10, 12; 10', 12' is identical, but the respective distance G2 of the central circumferential surface 11; 11' from the assigned rotational axis A2, A3 is even shorter.

The distances G3 of the circumferential surface sections 13, 14, 15, 16; 13', 14', 15', 16' of the casting rollers 2, 3 that respectively border laterally on the circumferential surface sections 10, 11, 12; 10', 11', 12' are constantly uniform. Accordingly, the circumferential surface sections 10, 11, 12; 10', 11', 12' are realized in the casting rollers 2, 3 like circumferential grooves, wherein their respective depth depends on the difference between their respective distance G1, G2 and the distance G3, by which the circumferential surface sections 13, 14, 15, 16; 13', 14', 15', 16' are respectively spaced apart from the assigned rotational axis A2, A3.

Between the respectively opposing circumferential surface sections 10, 10'; 11, 11; 12, 12' of the casting rollers 2, 3, the casting gap 4 therefore respectively has a clear width W1, W2 that is greater than the clear width W3 of the casting gap 4 between the mutually assigned circumferential surface sections 13, 13'; 14, 14'; 15, 15'; 16, 16'. The circumferential surface sections 13, 14, 15, 16; 13', 14', 15', 16' may have a width b1 that is wider than the width b2 of circumferential surface sections 10, 11, 12; 10', 11', 12'. In order to allow the shells being formed of the molten metal S to grow faster and therefore more substantially in the region of the circumferential surface sections 10, 11, 12; 10', 11', 12' than in the region of the circumferential surface sections 13, 14, 15, 16; 13', 14', 15', 16', cooling lines 20, 21 are respectively arranged in the casting rollers 2, 3 in the region of the circumferential surface sections 10, 11, 12; 10', 11', 12' and positioned closely adjacent to one another, wherein a cooling fluid flows through said cooling lines during the casting operation. Two cooling lines 20, 21 arranged closely adjacent to one another are respectively assigned to each of the circumferential surface sections 10, 11, 12; 10', 11', 12' in the embodiment illustrated in FIG. 2 and also to the outer circumferential surface sections 10, 12; 10', 12' in the example illustrated in FIG. 3, but three cooling lines 20, 21, 22 are provided in the deeper circumferential surface section 11 in the embodiment illustrated in FIG. 3 in order to ensure an even more intensive heat dissipation and therefore a faster growth of the shell.

In the region of the circumferential surface sections 13, 14, 15, 16; 13', 14', 15', 16' that are spaced apart from the respective rotational axis A2, A3 by a greater distance G3 and are wider than the circumferential surface sections 10, 11, 12; 10', 11', 12', in contrast, three cooling lines 23, 24, 25 are respectively provided and spaced apart from one another by a greater distance. Accordingly, less heat is dissipated in these regions during the casting operation than in the circumferential surface sections 10, 11, 12; 10', 11', 12' and the growth of the shells that form of the solidifying molten metal on the casting rollers and are joined into the cast strip B1 in the casting gap 4 progresses slower.

Figure 4:
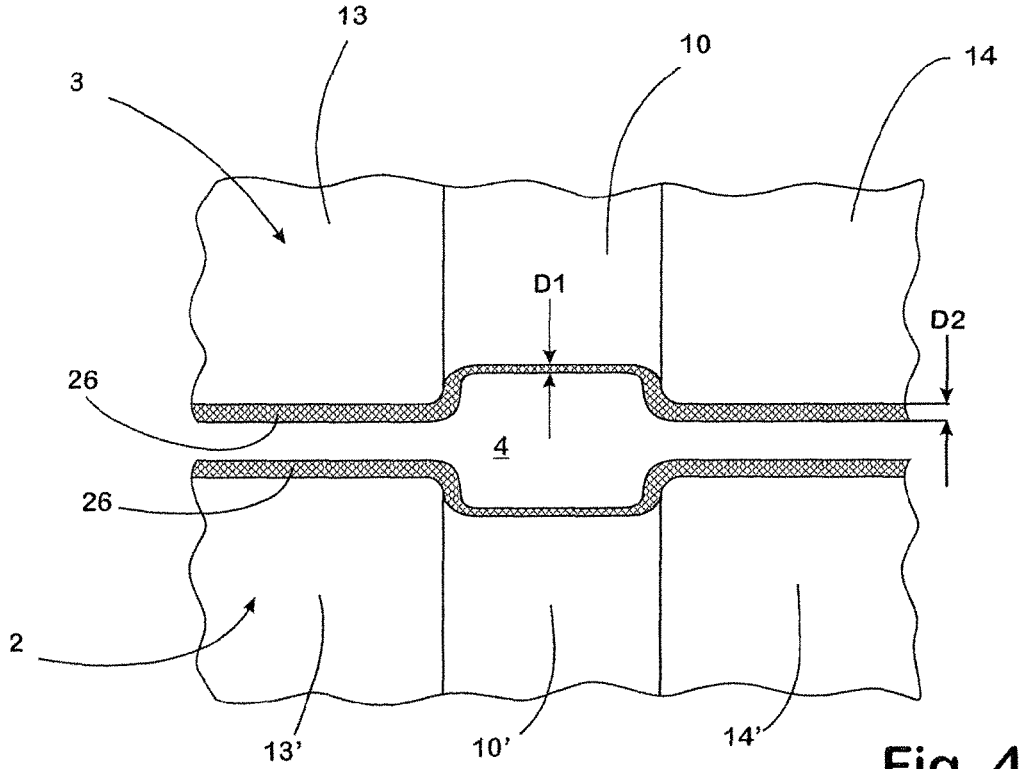
FIG. 4 shows a top view of an enlarged detail of the casting gap of the embodiment of the twin-roller casting machine illustrated in FIG. 2.

The different solidification speed of the molten metal S in the region of the respective circumferential surface sections 10-16; 10'-16' can also be promoted by providing the circumferential surface sections 10-16; 10'-16' with a coating 26 of different thickness D1, D2 as indicated in FIG. 4. In this case, the coating 26 consist, for example, of a Fe—Cu alloy or Cr—Ni alloy. The thickness D1 of the coating 26 in the region of the circumferential surface sections 10, 11, 12; 10', 11', 12' with a shorter distance G1, G2 is smaller than the thickness D2 of the coating in the region of the circumferential surface sections 13, 14, 15, 16; 13', 14', 15', 16' with a greater distance G3. The coating 26 serves as a wear protection layer for the casting roller surface, but its insulating effect also influences the heat transfer from the molten metal S to the respective casting roller 2, 3. Due to the smaller thickness D1 of the coating 26 in the region of the circumferential surface sections 10, 11, 12; 10', 11', 12', more heat is accordingly dissipated from the molten metal S at these locations than in the region of the circumferential surface sections 13, 14, 15, 16; 13', 14', 15', 16', in which the coating 26 is thicker.

Figure 5:
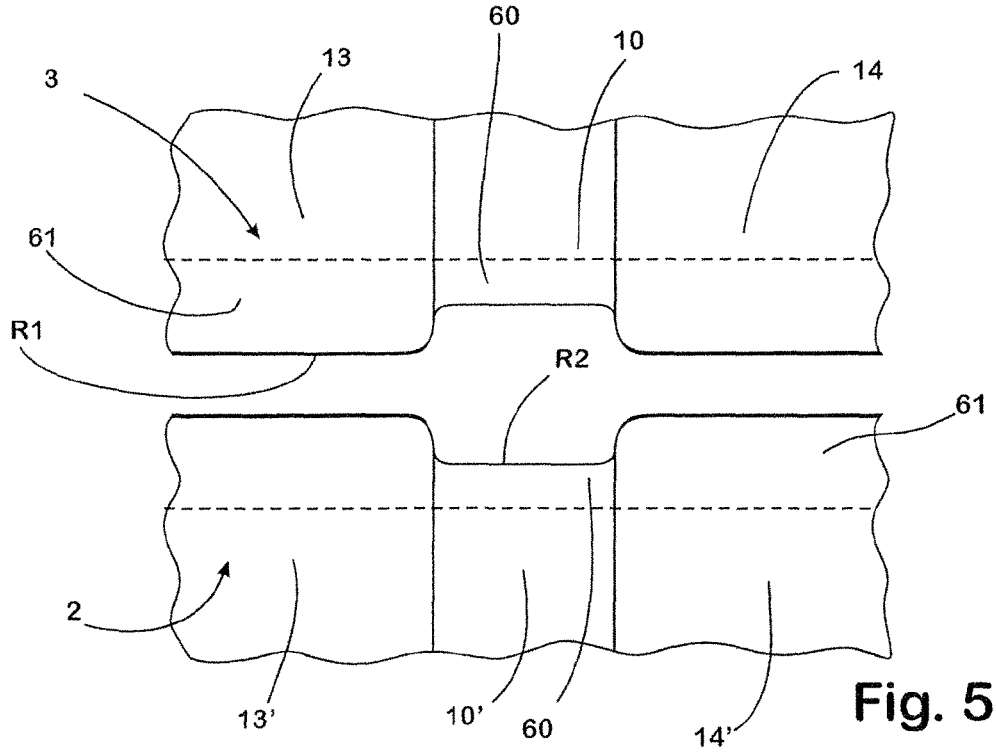
FIG. 5 shows a top view of an enlarged detail of the casting gap of the embodiment of the twin-roller casting machine illustrated in FIG. 3.
Figure 6:
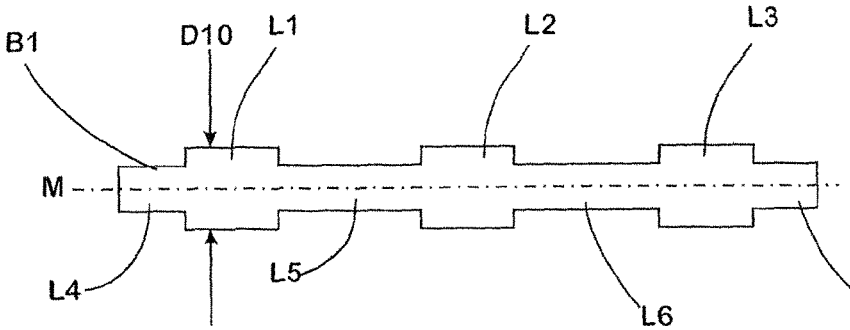
FIGS. 6-10 show different strips cast in accordance with the invention in the form of a section transverse to their longitudinal direction.

The different solidification speed is also promoted in that the coating 26 or the circumferential surfaces of the casting rollers 2, 3 that respectively come in contact with the molten metal S have a different roughness R1, R2 in the region of the circumferential surface sections 10-16; 10'-16' as indicated in FIG. 5. In this case, the circumferential surface sections 10-16; 10'-16' were shot-peened in order to adjust their roughness R1, R2. The peening treatment was carried out in such a way that the circumferential surface sections 13, 14, 15, 16; 13', 14', 15', 16' have a greater roughness R1 than the circumferential surface sections 10, 11, 12; 10', 11', 12' with their roughness R2.

According to FIG. 5, the casting rollers 2, 3 may furthermore be realized in the form of hollow shafts, through which a cooling medium flows. In this case, the different cooling effect in the region of the circumferential surface sections 13, 14, 15, 16; 13', 14', 15', 16' and in the region of the circumferential surface sections 10, 11, 12; 10', 11', 12' is achieved in that the wall thickness of the casting rollers 2, 3 is greater in the region 60 of the circumferential surface sections 13, 14, 15, 16; 13', 14', 15', 16' than in the region 61 of the circumferential surface sections 10, 11, 12; 10', 11', 12'.

FIGS. 6 to 10 show different examples of cross-sectional shapes and thickness profiles of a strip B1, B2, B3, B4, B5 cast in accordance with the invention. The strip B1 illustrated in FIG. 6 can be produced with casting rollers 2, 3 realized in accordance with FIG. 2 and the strip B2 illustrated in FIG. 7 can be produced with casting rollers realized in accordance with FIG. 3. In these embodiments, the thicknesses of the length sections L1-L7 are respectively realized symmetrically referred to the center plane M of the cast strip B1, B2 and extend over the entire length of the cast strip in the longitudinal direction L as shown in FIG. 11. In the embodiment according to FIG. 6, the thicker length sections L1, L2, L3 produced by the circumferential surface sections 10, 11, 12; 10', 11', 12' have the same thickness D10 and the length sections L4, L5, L6, L7 that lie in between and are produced by the circumferential surface sections 13, 14, 15, 16; 13', 14', 15', 16' have the same smaller thickness D13.

Figure 7:
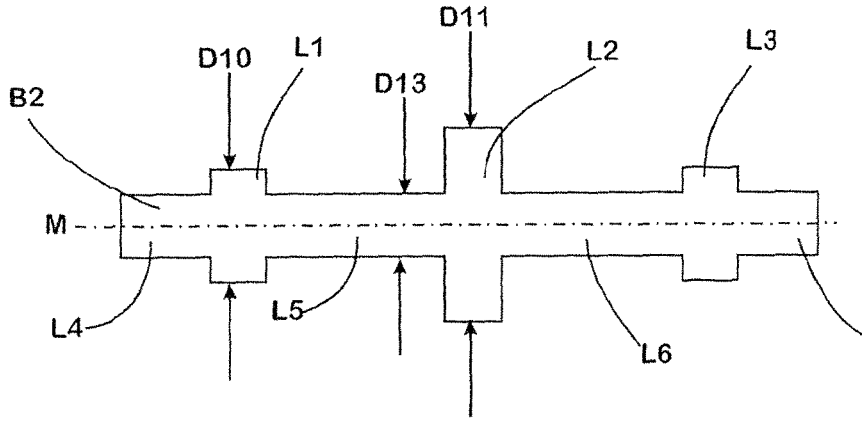

In the exemplary embodiment according to FIG. 7, in contrast, the central length section L2 has a greater thickness D11 than the two other thicker length sections L1, L3 with their thickness D10, as well as the length sections L4-L7 that lie in between with their thickness D13.

Figure 8:
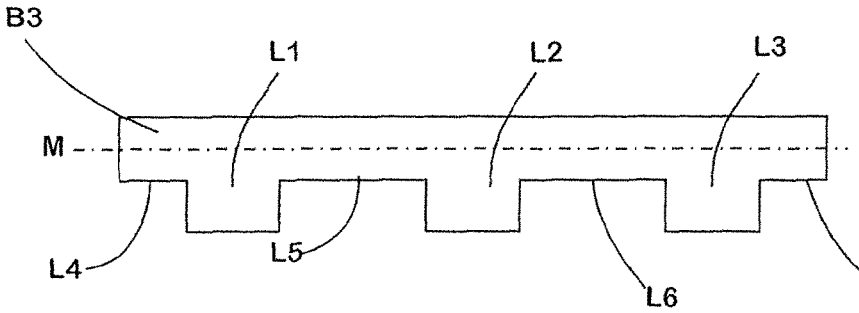
Figure 9:
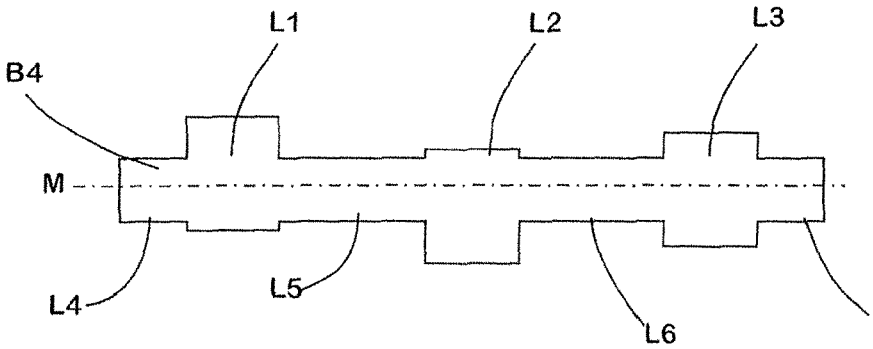
Figure 10:
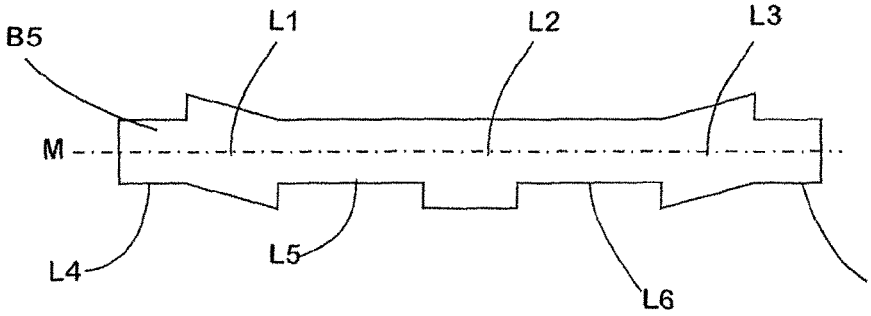
Figure 11:
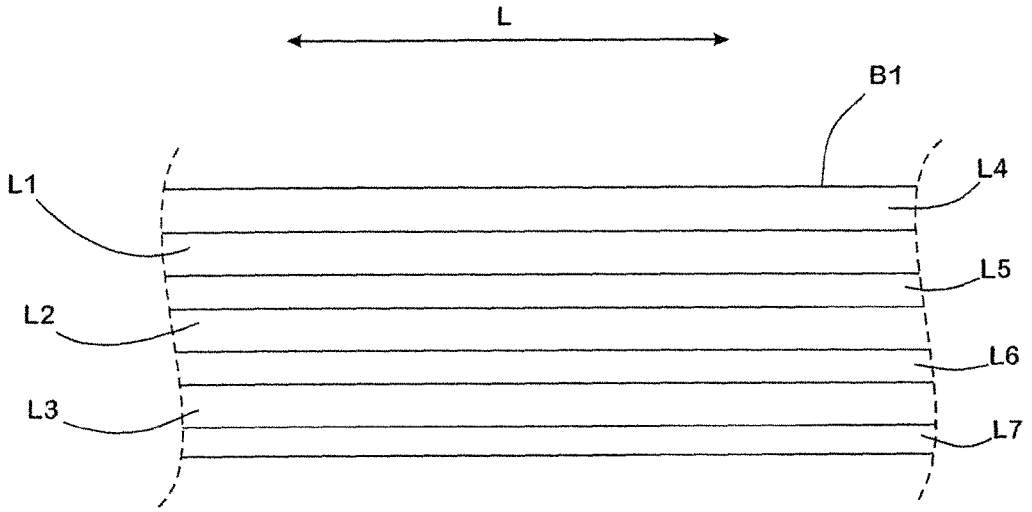
FIGS. 11-12 show top views of different strips cast in accordance with the invention.

In the strips B3-B5 illustrated in FIGS. 8-10, the length sections L1, L2, L3 with greater thickness are arranged asymmetrically referred to the center plane M or varied with respect to their shape.

Figure 12:
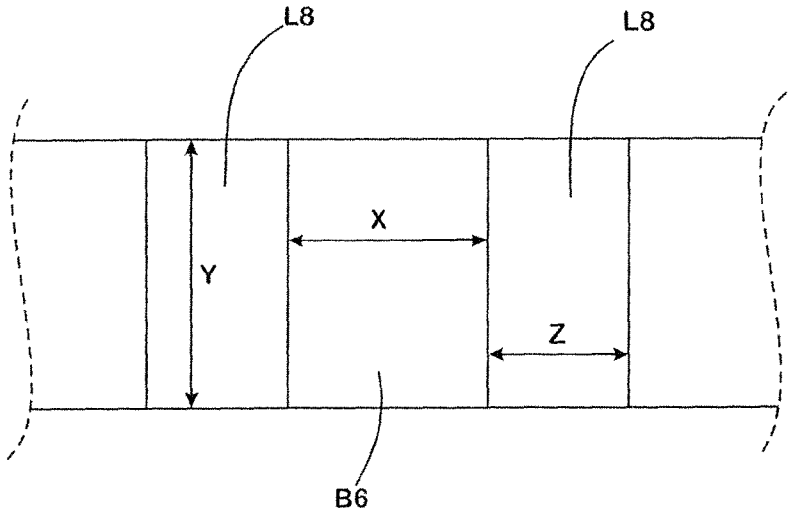

According to FIG. 12, it is also possible to produce a thicker length section L8, which extends over the entire width Y of the cast strip B6 and has a length Z that is limited to a fraction of the circumferential length of the casting rollers 2, 3, on the cast strip B6 in accordance with the invention within periodically repeating distances X.

Figure 13:
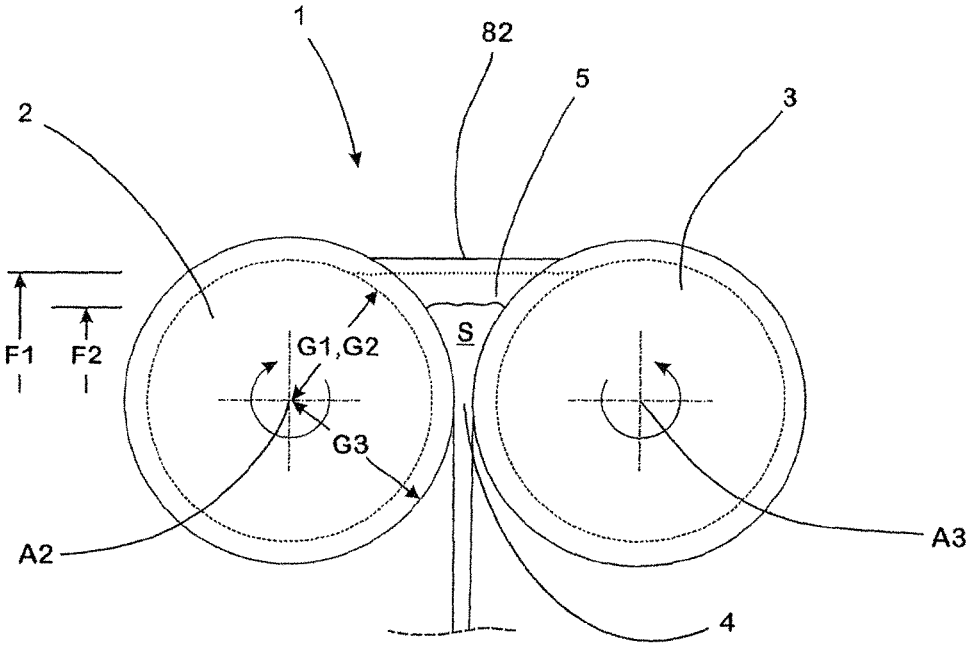
FIG. 13 shows a side view of another embodiment of a twin-roller casting machine for casting molten steel into a cast strip.
Figure 14:
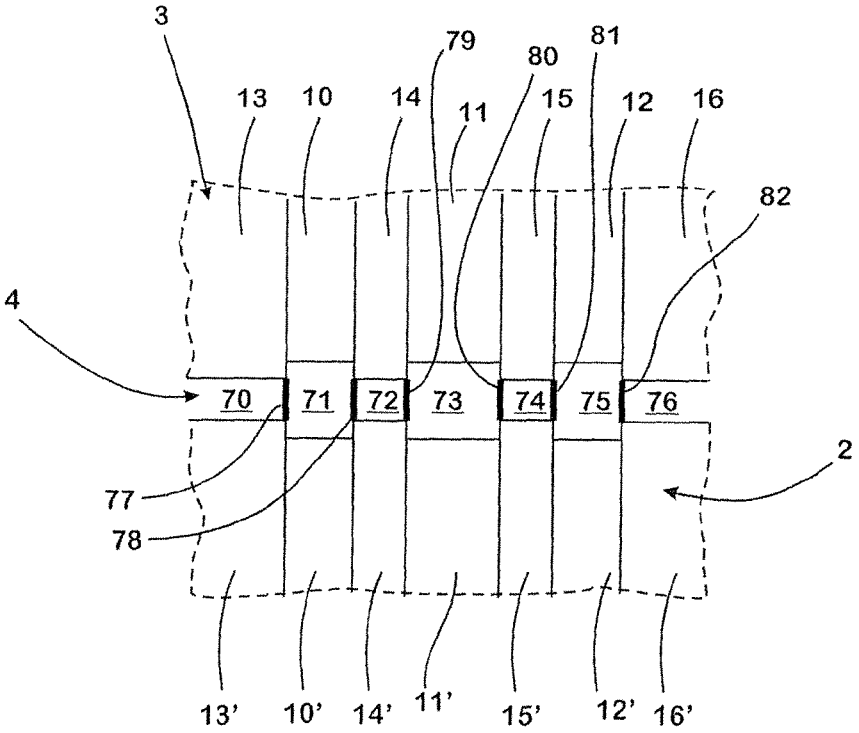
FIG. 14 shows a top view of a detail of the casting gap of the twin-roller casting machine according to FIG. 13.

FIGS. 13 and 14 show another option for controlling the growth of the shells that are respectively formed of the solidifying molten metal S in the region of the circumferential surface sections 10-16' producing the length sections L1-L7. In this case, the sections 70-76 of the casting gap 4 assigned to the oppositely arranged circumferential surface sections 10, 10'; 11, 11'; 12, 12'; 13, 13'; 14, 14'; 15, 15'; 16, 16' are separated from one another by partitions 77-82. This makes it possible to realize a higher filling level F1 of the molten metal S in the sections 71, 73, 75 that are assigned to the circumferential surface sections 10, 10'; 11, 11'; 12, 12'; 13, 13' with a shorter distance G1 from the respective rotational axis A2, A3 of the casting rollers 2, 3 than in the other sections 70, 72, 74, 76, in which a lower filling level F2 is maintained.

In this way, prolonged contact between the molten metal S and the respective casting roller 2, 3 is realized in the region of the sections 71, 73, 75 of the casting gap such that a longer time period is available for the growth of the shells being formed of the solidified molten metal S on the respective casting rollers 2, 3. Consequently, thicker shells are formed in the region of the circumferential surface sections 10-13' with a shorter distance G1 from the respective rotational axis A2, A3 of the casting rollers 2, 3 than in the region of the other circumferential surface sections 14-16' of the casting rollers 2, 3 such that the joining of the shells in the narrowest point of the casting gap can once again take place in a uniform fashion and the thickness of the still molten steel present in the interior of the cast strip is evenly distributed over the width of the strip. Analogous to the other measures described herein, this also makes it possible to realize a homogenous microstructure in the cast strip despite the uneven thickness distribution.

Figure 15:
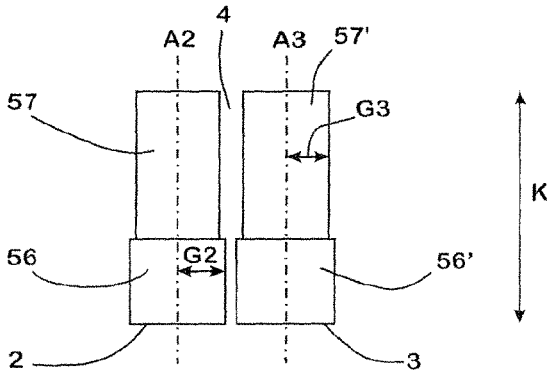
FIG. 15 shows a top view of a detail of a pair of casting rollers used in a practical casting test.
Figure 16:
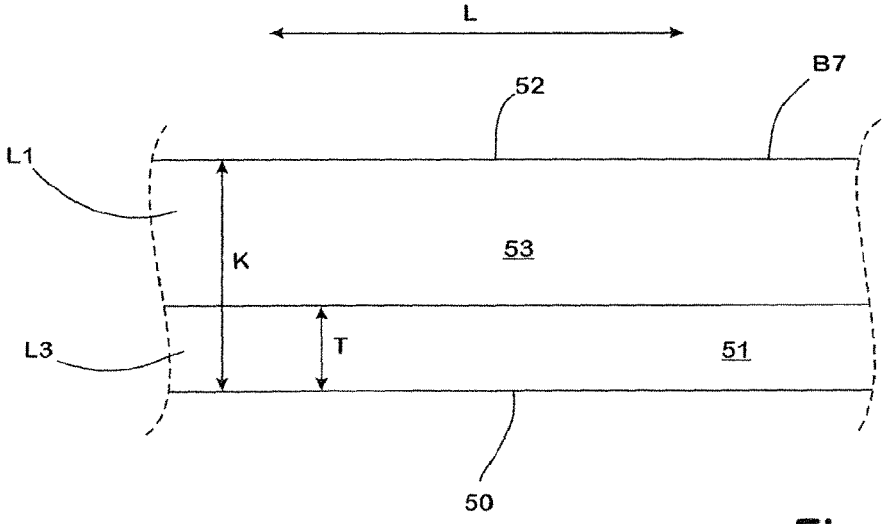
FIG. 16 shows the cast strip produced with the pair of casting rollers in the form of a sectional representation according to FIGS. 6-10.

A practical test is described below with reference to FIGS. 15 and 16: In order to produce a steel strip, for example, with a thickness of 2 mm, it is known from conventional casting machines that a contact time $t_c$ of 0.29 seconds is required for the solidification on casting rollers with a shot-peened surface while a contact time of 0.4 s is required for casting rollers that are merely coated with a sprayed layer. In this case, the empirically determined relation $t_c=c*d^2$ can generally be formulated with c=0.0725 s/mm$^2$ for shot-peened roller surfaces and c=0.1 s/mm$^2$ for thermally sprayed roller surfaces.

At the same melt pool filling level, this relation results in a thickness ratio of the solidified strip shells of 0.85 between roller surface regions with a sprayed layer coating and shot-peened surfaces (determined in the form of the root of the two constants c). Since this applies to both rollers, the ratio between the strip thicknesses doubles after the strip exits the gap between the rollers.

A strip B7 with a width of 150 mm should be profiled symmetrically referred to its center plane M. In a length section 51 bordering on one longitudinal side 50, the thickness of the length section 51 should amount to 1.4 mm over a width T of 50 mm. In the length section 53 bordering on the length section 51 and the other longitudinal side 52 of the cast strip B7, in contrast, the strip B7 should have a thickness of 2 mm.

In order to produce such a strip, a pair of casting rollers 2, 3 with a width K of 150 mm was utilized. In this case, the rollers 2, 3 contained two circumferential surface sections 56, 57; 56', 57', wherein the circumferential surface section 56, 56' assigned to the thinner length section 51 of the cast strip B7 was spaced apart from the rotational axis A2, A3 of the casting rollers 54, 55 by a distance G2 that was 0.3 mm greater than the distance G3 of the circumferential surface section 57 assigned to the thicker length section 53. The circumferential surface section 56 was coated with a sprayed thermal layer while the circumferential surface section 56 was abraded by means of shot-peening. This made it possible to realize the strip cast of molten steel S with a thickness jump from 1.4 mm to 2.0 mm transverse to the longitudinal direction.

The invention claimed is:

1. A method for producing a cast strip from molten metal, in which the molten metal is poured into a casting gap defined by two oppositely rotating casting rollers and, upon contacting the casting rollers, is shaped into a cast strip, wherein the cast strip is in the casting gap provided with a first thickness in a first length section extending in a longitudinal direction of the cast strip and a second thickness in a second length section bordering thereon, wherein the first thickness is greater than the second thickness, wherein at least one of the casting rollers has a circumferential surface section associated with the first length section that is spaced apart from the rotational axis of the respective casting roller by a different distance than a closest adjacent circumferential surface section of the at least one casting roller associated with the second length section, and in addition to the difference between the distance that the circumferential surface section associated with the first length section is spaced apart from the rotational axis of the respective casting roller and the distance that the closest adjacent circumferential surface section associated with the second length section is spaced apart from the rotational axis of the respective casting roller, a surface structure of the casting roller in the circumferential surface section associated with the first length section is different from a surface structure of the casting roller in the circumferential surface section associated with the second length section such that the cooling imparted to the cast strip is uniform.

2. The method according to claim 1, wherein the first length section and the second length section extend over a fraction of a width of the cast strip.

3. The method according to claim 2, wherein at least one of the casting rollers features a circumferential surface section that is spaced apart from the rotational axis of the respective casting roller by a different distance than a closest adjacent circumferential surface section of this casting roller.

4. The method according to claim 1, wherein the circumferential surface sections with different distances from the rotational axis of the casting roller extend around the casting roller.

5. The method according to claim 1, wherein the surface of the circumferential surface section associated with the first length section has a first roughness, the surface of the circumferential surface section associated with the second length section has a second roughness, and the first roughness is different from the second roughness.

6. The method according to claim 1, wherein the difference between the surface structure of the circumferential surface section associated with the first length section and the circumferential surface section associated with the second length section results in a difference in cooling between the circumferential surface section associated with the first length section and the circumferential surface section associated with the second length section.

7. The method according to claim 1, wherein the surface of the circumferential surface section associated with the first length section is coated with a first coating, the surface of the circumferential surface section associated with the second length section is coated with a second coating, and the first coating is different from the second coating.

8. The method according to claim 7, wherein a coating thickness of the first coating applied to the circumferential surface section associated with the first length section is different from a coating thickness of the second coating applied to the circumferential surface section associated with the second length section.

9. The method according to claim 8, wherein a thermal conductivity of the first coating applied to the circumferential surface section associated with the first length section is different from a thermal conductivity of the second coating applied to the circumferential surface section associated with the second length section.

10. The method according to claim 7, wherein a thermal conductivity of the first coating applied to the circumferential surface section associated with the first length section is different from a thermal conductivity of the second coating applied to the circumferential surface section associated with the second length section.

11. The method according to claim 1, wherein the heat transfer referred to the molten metal in the first length section is greater than the heat transfer referred to the molten metal in the second length section.

12. A method for producing a cast strip from molten metal, in which the molten metal is poured into a casting gap defined by two oppositely rotating casting rollers and, upon contacting the casting rollers, is shaped into a cast strip, wherein the cast strip is in the casting gap provided with a different thickness in a first length section extending in a longitudinal direction of the cast strip than in a second length section bordering thereon, and circumferential surface sections with different distances from a rotational axis of the casting roller and associated with the first length section and the second length section have a different heat transfer referred to the molten metal, wherein the difference in heat transfer between the first length section and the second length section is achieved by providing partitions in the casting gap separating the casting gap into sections that cause a filling level of the melt pool in a section corresponding to the first length section to be different than a filling level of the melt pool in a section corresponding to the second length section bordering thereon.

13. A method for producing a cast strip from molten metal, in which the molten metal is poured into a casting gap defined by two oppositely rotating casting rollers and, upon contacting the casting rollers, is shaped into a cast strip, wherein the cast strip is in the casting gap provided with a different thickness in a first length section extending in a longitudinal direction of the cast strip than in a second length section bordering thereon, and that circumferential surface sections with different distances from a rotational axis of the casting roller and associated with the first length section and the second length section have a different heat transfer referred to the molten metal, wherein a thickness of the cast strip associated with the first length section is greater than a thickness of the cast strip associated with the second length section and a width of the cast strip associated with the first length section is less than a width of the cast strip associated with the second length section.

* * * * *